US005983967A

United States Patent [19]

Gross et al.

[11] Patent Number: 5,983,967

[45] Date of Patent: Nov. 16, 1999

[54] TOOLHEAD FOR A SHAPING MACHINE

[75] Inventors: Hermann Gross, Lautenbach; Albert Haas, Appenweier, both of Germany

[73] Assignee: Gebruder Linck Maschinenfabrik "Gatterlinck"GmbH & Co. KG, Oberkirch, Germany

[21] Appl. No.: 08/930,390

[22] PCT Filed: Mar. 6, 1996

[86] PCT No.: PCT/EP96/00946

§ 371 Date: Dec. 18, 1997

§ 102(e) Date: Dec. 18, 1997

[87] PCT Pub. No.: WO96/32234

PCT Pub. Date: Oct. 17, 1996

[30] Foreign Application Priority Data

Apr. 11, 1995 [DE] Germany ..... 195 13 699

[51] Int. Cl.[6] ..... B27G 13/04; B27L 11/02

[52] U.S. Cl. ..... 144/235; 144/176; 144/220; 407/31

[58] Field of Search ..... 144/3.1, 39, 162.1, 144/178, 218, 220, 235, 223, 373; 241/293; 407/31

[56] References Cited

U.S. PATENT DOCUMENTS 3,780,778 12/1973 Chapman .
3,889,333 6/1975 Katz et al. .
4,263,949 4/1981 Kivimaa .
4,456,045 6/1984 Gregoire .

FOREIGN PATENT DOCUMENTS 30 38 674 10/1980 Germany .
30 38 566 5/1982 Germany .
89/04748 6/1989 WIPO .

OTHER PUBLICATIONS

Brochure: CyTec Zylindertechnik GmbH "Flexible Production Systems" (Mar. 1992) pp. 1–17.

*Primary Examiner*—W. Donald Bray
*Attorney, Agent, or Firm*—Burns, Doane, Swecker & Mathis, L.L.P.

[57] ABSTRACT

The invention concerns a tool head for shaping machine designed to machine the side segments of tree trunks. The tool head has a rotationally driven main body (1) with several groups of chipper blades (2, 3) round its circumference. The front chipper blade (2) in each group and a front-mounted finishing tool, e.g. a segment (4) of a circular-saw blade, are mounted on a common tool carrier (5). The tool carrier (5) is detachably attached to the tool-head main body (1) and is held in place by clamps (16). If, as a result of wear, it becomes necessary to replace a tool, the tool carrier is replaced after the clamp (16) has been loosened.

10 Claims, 4 Drawing Sheets

TOOLHEAD FOR A SHAPING MACHINE

BACKGROUND OF THE INVENTION

The invention relates to a toolhead for a profile machining tool for machining the lateral segments of logs having a rotationally-driven toolhead main body with a plurality of chopping teeth groups on its periphery and at least one planing tool on its face, wherein each group of chopping teeth exhibits at least one chopping tooth on the face.

Profile machining tools of this type are known (e.g. DE 3038566 C2). They remove lateral segments from logs that are unworked or evened on two sides, wherein the chopping teeth of the toolhead produce product chips. A planing tool mounted on the face of the toolhead and often comprising circular saw segments, a circular saw ring, or planing teeth finishes the surface generated on the log. The planing tool can be placed so that it cuts before or after the adjacent chopping tooth, designated here as a "face chopping tooth." Preceding planing teeth prevent any cracks originated from the face chopping tooth from extending down into the remaining wooden surface. Succeeding planing teeth finish the relatively uneven wooden surface generated by the face chopping teeth.

Due to the unavoidable wear, the planing teeth and chopping teeth must be replaced regularly. The relatively long associated downtime is a major disadvantage of such toolheads.

One known toolhead of this type (DE 28 50 263 A1) uses a replaceable planing tool fastened to the toolhead main body. However, the chopping teeth and especially the wear-prone face chopping teeth must still be replaced individually.

Thus, it is the object of the invention to configure the toolhead of the type cited in the beginning such that the downtimes necessitated by unavoidable tool wear are greatly reduced.

SUMMARY OF THE INVENTION

This object is accomplished according to the invention by attaching both the face chopping tooth and the planing tool to a common toolholder, which is replaceably fastened to the toolhead main.

Hence, replacement of the planing tools and the face chopping teeth in each group of chopping teeth is much simpler and easier. It is sufficient to detach the toolholder from the toolhead main body and exchange the toolhead for a new toolholder having pre-adjusted tools such that an adjustment of the tool cutting edges in their mounted state on the toolhead is no longer necessary. The required downtime can be reduced to a few minutes so that tool change can be performed with only slight interruption during a current shift as well as at the end of a shift.

In this connection, experience showing that the planing tools and the face chopping teeth are the most wear-prone tools due to their constant engagement on every occurring log shape was used in the invention. In contrast, the chopping teeth further removed from the face axially are not in constant engagement, so they wear considerably less. Hence, these additional chopping teeth can be fastened directly to the toolhead main body.

Depending on the embodiment of the planing tools, the toolholder can be a ring segment or a ring. If circular saw segments, to which a respective group of chopping teeth is usually allocated, are used as planing tools, then it is advantageous to embody the toolholder as a ring segment bearing the face chopping tooth on its forward end and bearing the circular saw ring segment on its face as a planing tool.

If, however, the planing tool is embodied as a circular saw ring, it is practical to embody the toolholder as a ring as well.

A particularly preferred embodiment of the invention provides that the toolholder is fastened to the toolhead main body by means of quick-tensioning devices. These devices allow especially quick tool change so that required machine downtime can be reduced quite substantially.

The quick-tensioning device preferably has at least one tensioning pin protruding from and parallel with respect to axis to the toolholder and extending into a tensioning hole of the toolhead main body and herein respectively in engagement with a tensioning apparatus.

An especially favorable construction provides that the tensioning pins are also centered in the tensioning holes.

Rather than using quick-tensioning devices, it is also possible to screw the toolholder directly to the toolhead main body. This construction is simpler than using a quick-tensioning device and still keeps tool changes relatively brief.

BRIEF DESCRIPTION OF THE DRAWING

The invention is described below by way of example with reference to exemplary embodiments illustrated in the figures. Shown are FIG. 1 a toolhead of a profile machining tool in three-dimensional representation, showing one of the toolholders in a detached state and a central guide disc of the toolhead being omitted to simplify the drawing.

DETAILED DESCRIPTION OF PREFERRED EMBODIMENTS OF THE INVENTION

Figure 1:
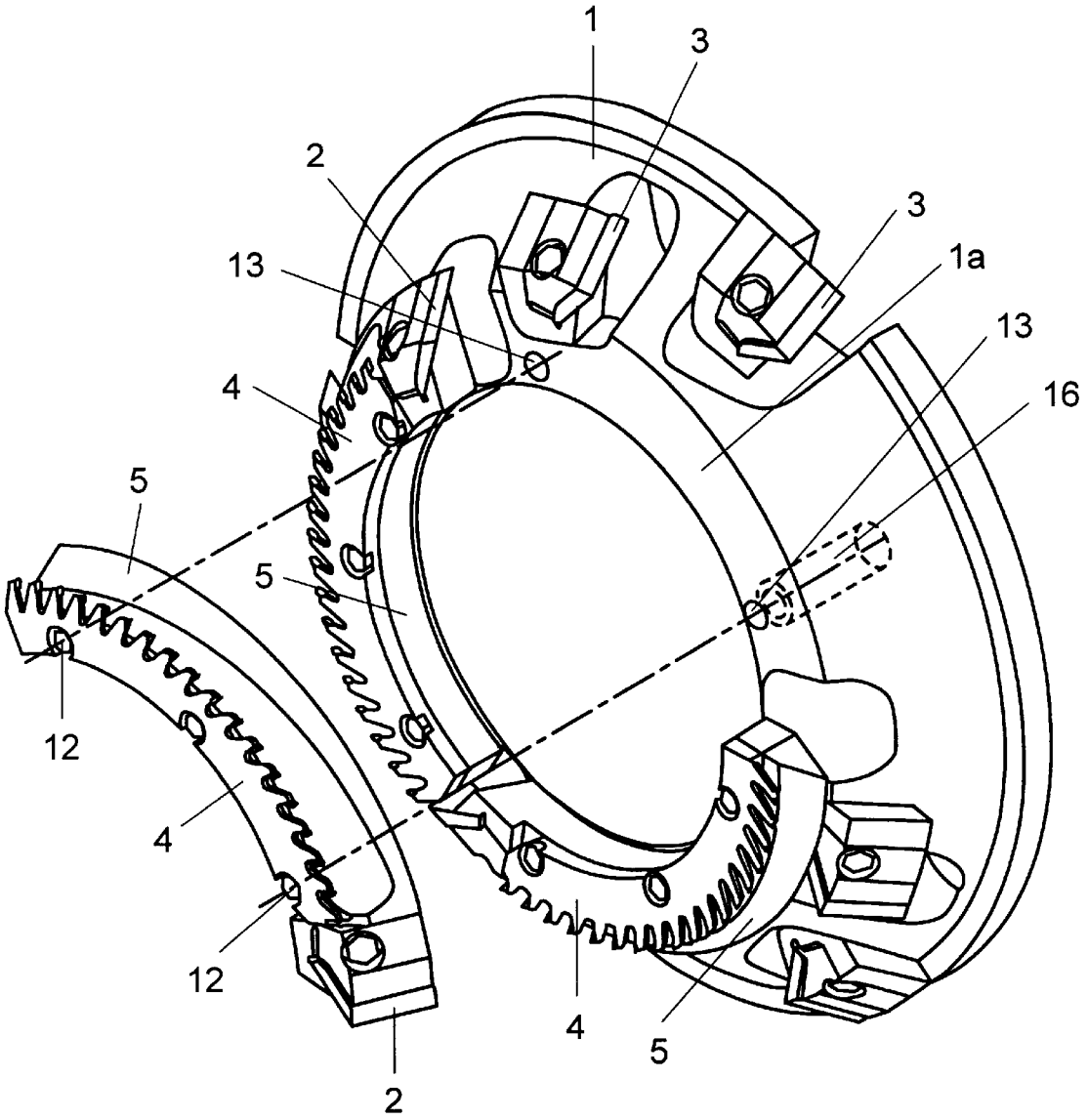

The toolhead of a profile machining tool depicted in FIG. 1 has on its periphery a substantially tapered toolhead main body 1 connected to a primary shaft (not shown) and bearing tools for machining product chips from the lateral segments of a log moving along the toolhead. Three groups of three chopping teeth 2 and 3, respectively, are attached to the periphery of the toolhead, wherein each group comprises a face chopping tooth 2 and two additional chopping teeth 3 staggered at an axial distance.

Three circular segment saw ring elements 4 are attached to the toolhead and function as planing tools to finish the created wooden surface.

A face chopping tooth 2 of each group and its respective circular saw ring element 4 are attached to a common toolholder 5, which is embodied as a ring segment in the specific embodiment depicted. Toolholder 5 is attached to the face of a front side 1*a* of toolhead main body 1 and is detachable and replaceable. In place of the embodiment depicted, toolholder 5 can also be embodied as a ring.

Figure 2:
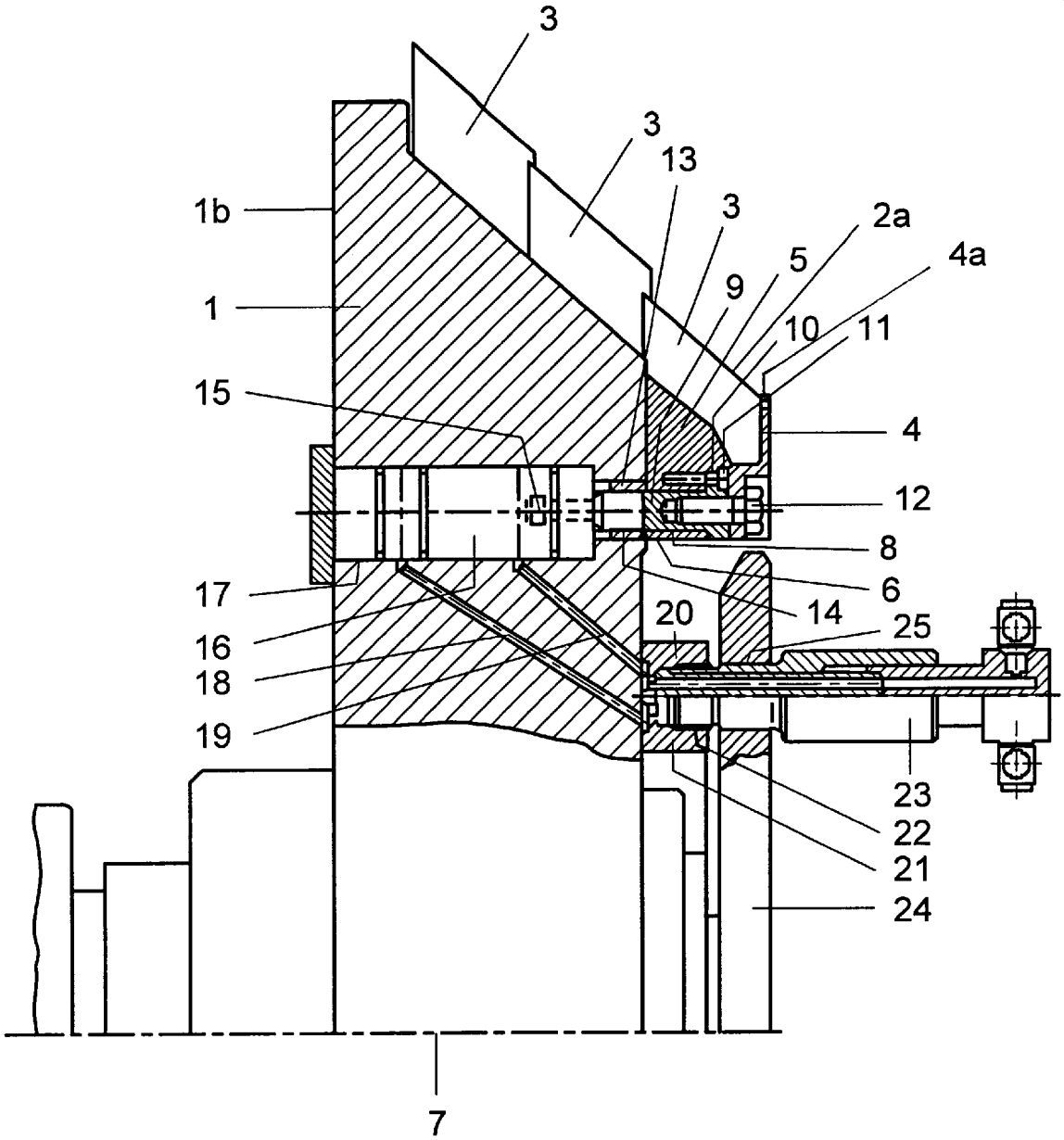
FIG. 2 an enlarged detail of a radial cross-section of the toolhead in accordance with FIG. 1 with an attached activating mechanism for a quick-tensioning device, and FIGS. 3 and 4 modified specific embodiments in respective detail of radial cross-sections in accordance with FIG. 2.

As shown in FIG. 2, toolholder 5 is fastened to toolhead main body 1 by means of quick-tensioning devices 6. On each toolholder 5, two tensioning pins 9 oriented parallel with respect to an axis 7 of rotation of the main body 1 are mounted to respective holes 8 running parallel to the rotational axis 7 of the toolhead, and each tensioning pin is fastened to toolholder 5 via a flange 10 by means of screws 11. The threads of fastening screws 12 for securing the saw ring segments 4 are screwed into respective tensioning pins 9.

Both tensioning pins 9 of each toolholder 5 extend into face tensioning holes 13 of tool holder main body 1 defined by a respective bushings 14. In this manner, tensioning pins 9 and thus also toolholders 5 are centered in tensioning holes 13.

Each tensioning pin 9 exhibits a thickened pull head 15 gripped from behind by a retaining element (not shown) of a tensioning apparatus 16. Tensioning apparatus 16 is set in an expanded prolongation 17 of tensioning hole 13. This is an example of a pneumatically-operated tensioning apparatus 16 like that known from the brochure "Innovative Docking and Tensioning Systems" by CyTec Zylindertechnik GmbH and commercially available. The retaining element gripping behind pull head 15 of this type of tensioning apparatus 16 is a pneumatically-operated collet chuck that, when under tension, remains under tension without pressure. The means of pressure delivery to activate the tension and release of tensioning apparatus 16 are the channels 18 and 19 terminating into a pressure-delivery coupling connector 20 on the face of toolhead main body 1. Alternatively, channels 18 and 19 could also run through the drive shaft of the profile cutter, for example.

For this purpose, the exemplary embodiment depicted is provided with a common connecting ring 21 for all tensioning apparatuses 16 of the toolhead, which ring is mounted at its face side to toolhead main body 1 and covers the terminations of channels 18 and 19. A supply outlet 23 can be inserted with a pressure-sealed connection into a connecting hole 22 of connecting ring 21. through which supply outlet 23 the pressure means necessary to actuate tensioning apparatus 16 is delivered and removed. A pivotably-seated supporting ring 24 on the face of the toolhead has a through-hole 25 through which supporting ring supply outlet 23 can be inserted up to connecting hole 22.

Each of the chopping teeth 2, 3 has a chopping edge 2*a*, 3*a*, and each of the planing tools includes a planing edge 4*a*. The chopping edge 2*a* is of longer length than the planing edge 4*a*, as can be seen in FIG. 2. Also, the chopping edges 2*a* extend closer to the rear side 1*b* than do the planing edges 4*a*. The chopping teeth 2 are spaced circumferentially apart, as are the planing teeth. The chopping teeth define a cutting circle of larger diameter than the planing edges, as is evident from FIG. 2.

Figure 3:
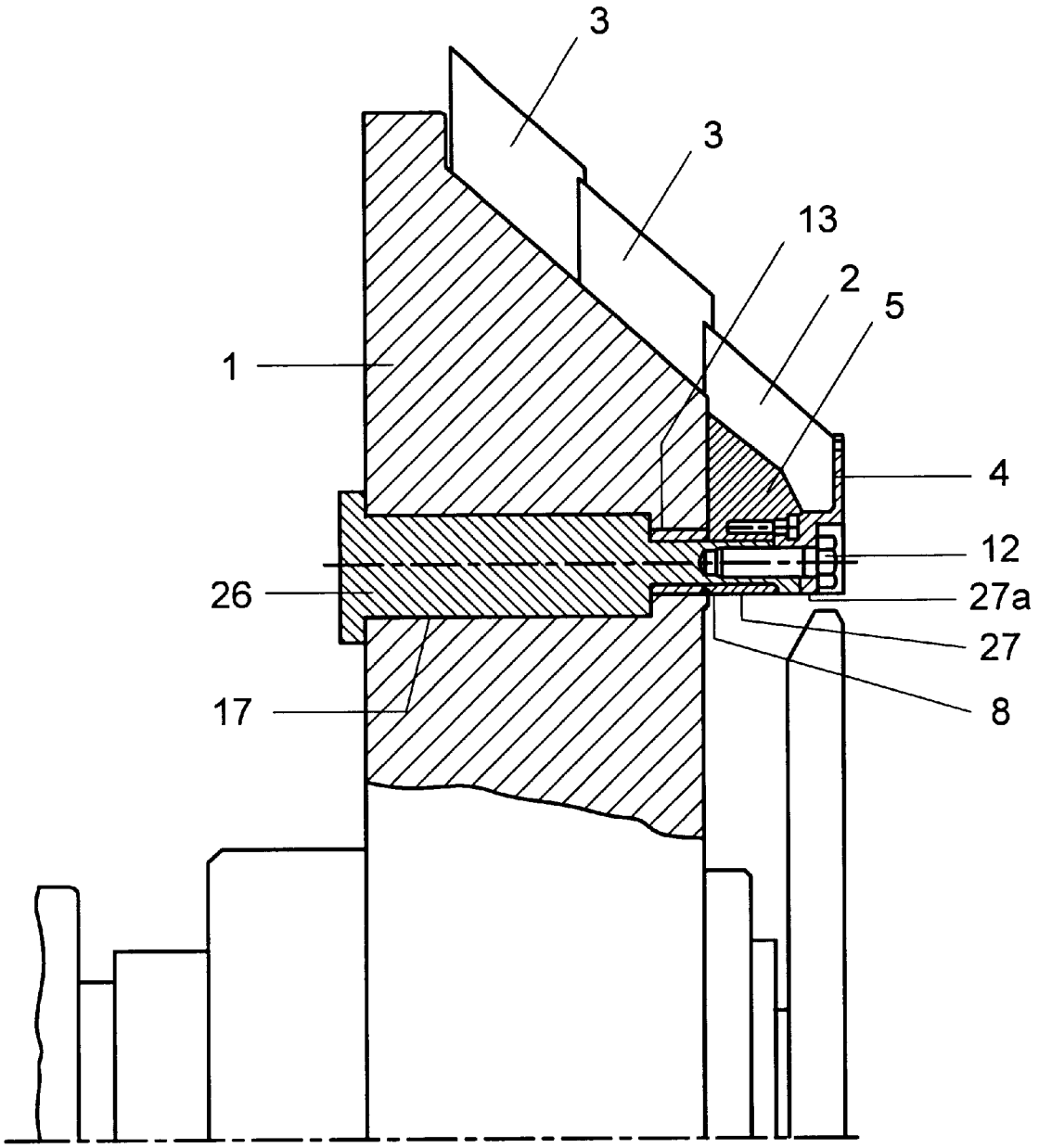

In the modified exemplary embodiment represented in FIG. 3 pneumatically-operated tensioning apparatus 16 shown in FIG. 2 is replaced by a staged bolt 26 inserted through a rear side 1*b* of the main body and into tensioning hole 13 and its prolongation 17, which staged bolt exhibits a centering pin 27 protruding from the face of toolhead main body 1. Toolholder 5 is screwed onto centering pin 27, which extends centered into hole 8 of toolholder 5 by means of mounting screws 12 of circular saw ring segment 4, wherein a spacer 27*a* is placed.

Figure 4:
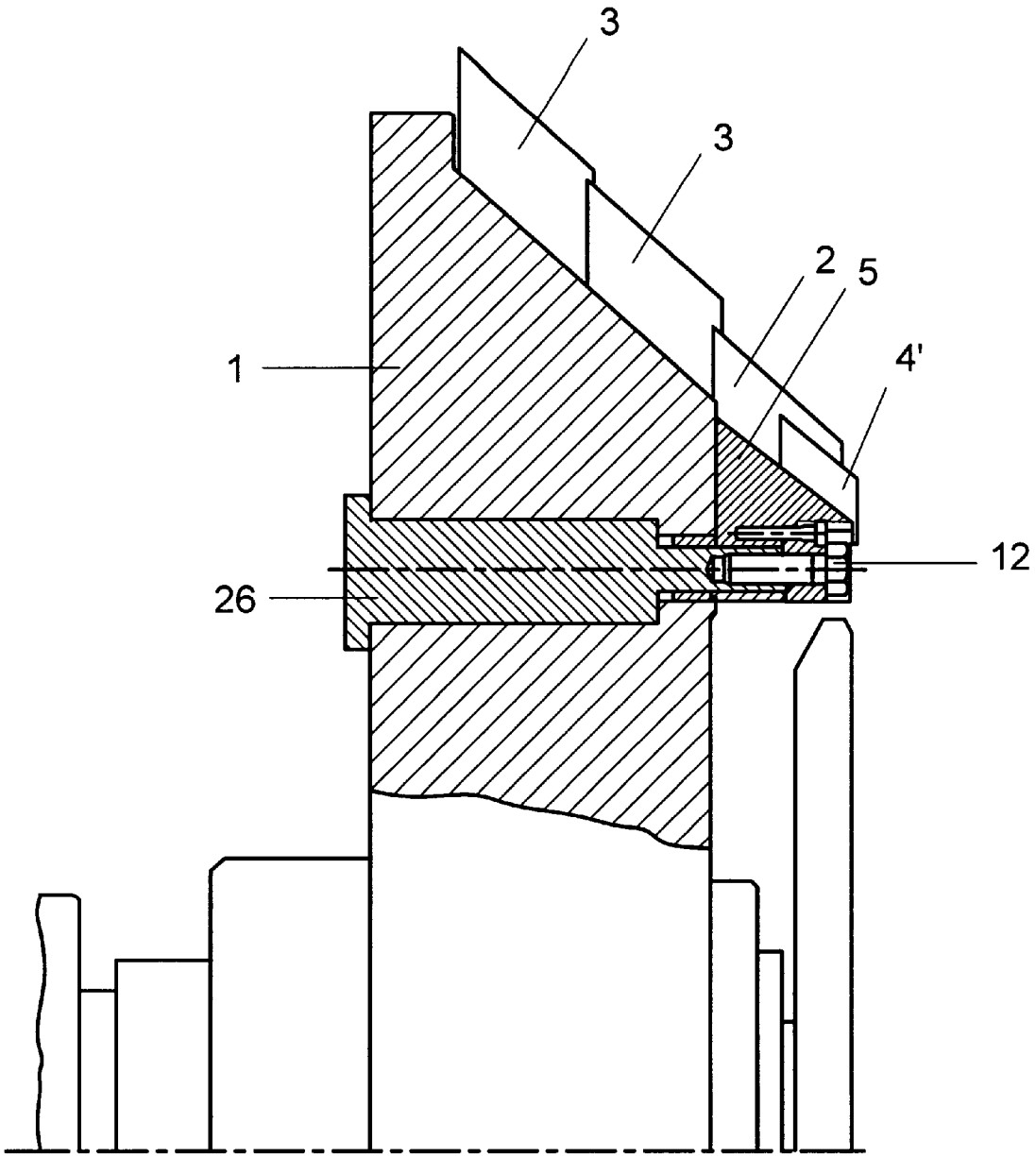

The exemplary embodiment shown in FIG. 4 differs from the exemplary embodiment in FIG. 3 only in that in place of circular saw ring segment 4, one or more planing teeth 4' is/are mounted on toolholder 5.

All of the exemplary embodiments shown allow toolholders 5 with attached circular saw ring segments 4 or planing teeth 4' and face chopping teeth 2 to be quickly and easily replaced when worn out. To do so, tensioning apparatuses 16 are released-or mounting screws 12 are loosened for the embodiments in FIG. 3 or 4—allowing toolholder 5 with the worn tools to be removed. New toolholder 5 bearing sharp pre-adjusted tools 2 and 4 or 4' is mounted on toolhead main body 1, centered and placed under tension such that the toolhead is immediately ready for use. All measures necessary to replace toolholder 5 can be carried out from the face side of the toolhead.

The claims made in this application do not preclude the assertion of additional protection within the framework of the overall contents of the application. The references of the dependent claims refer to additional embodiments of features of the main claim; but this does not represent a waiver of the assertion of independent protection for features of the dependent claims. At any time during the application process, features revealed only in the description may also be used as features significant for the invention to define the subject-matter of the application.

We claim:

1. A toolhead for cutting wood workpieces comprising:

a main body including a front side and a rear side spaced apart along an axis disposed substantially perpendicularly to a direction of feed of wood workpieces, the main body being rotatable about the axis as the workpieces are fed adjacent the front side;

a plurality of chopping teeth and a plurality of planing teeth arranged on the body to rotate therewith, the chopping teeth including respective chopping edges, and the planing teeth including respective planing edges, the chopping teeth and the planing teeth being distributed circumferentially with respect to the axis, the chopping edges being of longer length than the planing edges and defining a cutting circle of larger diameter than the planing edges, the chopping edges extending closer to the rear side of the main body than do the planing edges; and a toolholder removably mounted on the front side of the main body and carrying at least one of the chopping teeth and at least one of the planing teeth, whereby the at least one chopping tooth and the at least one planing tooth are installable and removable together with respect to the main body.

2. The toolhead according to claim 1 wherein the toolholder comprises a segment of a ring.

3. The toolhead according to claim 1 wherein the toolholder is ring-shaped.

4. The toolhead according to claim 1 wherein the planing teeth comprise saw teeth.

5. The toolhead according to claim 4 wherein the toolholder is in the form of a ring segment and includes forward and rearward ends, a chopping tooth being mounted at the forward end.

6. The toolhead according to claim 5 wherein the main body includes a tensioning hole, a tensioning device mounted in the main body in alignment with the tensioning hole, a tensioning pin extending through the toolholder in a direction parallel to the axis of rotation and received in the tensioning hole and engaged by the tensioning device, and a fastener received in the tensioning pin for releasably mounting the toolholder on the main body.

7. The toolhead according to claim 6 wherein the tensioning pin includes a pull head engaged by the tensioning device.

8. The toolhead according to claim 7 further including channels formed in the main body for conducting fluid to and from the tensioning device for displacing the tensioning pin.

9. The toolhead according to claim 5 wherein the fastener comprises a screw.

10. The toolhead according to claim 9 further including a centering pin extending through the tensioning hole, the screw extending into the centering pin.

* * * * *